US007287870B1

(12) United States Patent
Knoch

(10) Patent No.: US 7,287,870 B1
(45) Date of Patent: Oct. 30, 2007

(54) ILLUMINATED CAKE STAND DISPLAY

(76) Inventor: Joanne J. Knoch, W4743 10th Rd., Westfield, WI (US) 53964

( * ) Notice: Subject to any disclaimer, the term of this patent is extended or adjusted under 35 U.S.C. 154(b) by 0 days.

(21) Appl. No.: 11/352,751

(22) Filed: Feb. 13, 2006

(51) Int. Cl.
*G09F 13/04* (2006.01)

(52) U.S. Cl. ..... 362/97; 362/806; 362/84; 362/249; 362/252

(58) Field of Classification Search ..... None
See application file for complete search history.

(56) References Cited

U.S. PATENT DOCUMENTS

| | | | | |
|---|---|---|---|---|
| 1,707,539 | A | 4/1929 | Propp | |
| 1,847,687 | A | 3/1932 | Biertuempfel | |
| 2,013,286 | A * | 9/1935 | Naramore | 108/22 |
| 2,090,248 | A * | 8/1937 | Chakow | 108/23 |
| 2,350,340 | A * | 6/1944 | Darby | 108/23 |
| 2,921,691 | A | 1/1960 | Dembinski | |
| 3,624,381 | A * | 11/1971 | Pollack et al. | 108/23 |
| 3,690,610 | A | 9/1972 | Peirce | |
| 3,744,166 | A | 7/1973 | Rielle | |
| 3,814,032 | A * | 6/1974 | McMains | 108/101 |
| 3,843,220 | A | 10/1974 | Snider | |
| 4,069,772 | A | 1/1978 | Haapala | |
| 4,416,075 | A | 11/1983 | Bauer | |
| 4,947,722 | A | 8/1990 | Lewis | |
| 5,428,516 | A * | 6/1995 | Harris | 362/653 |
| 6,170,961 | B1 * | 1/2001 | Knoch | 362/234 |
| 6,508,572 | B2 * | 1/2003 | Kumada | 362/252 |
| 2006/0215417 | A1 * | 9/2006 | Chen | 362/555 |

* cited by examiner

*Primary Examiner*—Sandra O'Shea
*Assistant Examiner*—Kristen A Manskar
(74) *Attorney, Agent, or Firm*—Lathrop & Clark LLP

(57) ABSTRACT

An illuminated display system or assembly. In particular, the illuminated system is designed to display various food items such as wedding cakes, hors d'oeuvres, buffets, pies, and the like. The assembly includes a plurality of plates and sheets adapted to be engaged to form enclosures for lighting. Lighting is secured to the sheets within the enclosures. The assembly further includes one or more pillars each adapted to engage the plates and to house additional lighting. The invention also includes methods of assembling the display system and methods of displaying and illuminating the various food items.

21 Claims, 6 Drawing Sheets

ILLUMINATED CAKE STAND DISPLAY

FIELD OF THE INVENTION

The present invention relates to illuminated display stands for food items, particularly baked goods and hors d'oeuvres, and more particularly tiered wedding cakes.

BACKGROUND OF THE INVENTION

A wedding celebration is a momentous occasion, not only for the bride and groom, but also for the families, friends, and acquaintances of the married couple. The importance of the event is marked in numerous ways: the distinctive garb of the wedding party, the provision of music, dancing, floral arrangements, table decorations, food and drink. Pride of place among the table decorations and ornaments is accorded the wedding cake. The wedding cake, in addition to serving as a conclusion to the wedding meal, stands as a prominent symbol of the event, usually in full view of the participants, throughout the time prior to and during the consumption of the wedding lunch or dinner.

Because of its importance, significant care and expense are invested in providing a wedding cake which is not only satisfying to eat, but attractive to look upon. Regardless of the quantity of cake required to satisfy the guests, the symbolic importance of of the cake often requires that it extend vertically above the tabletop to serve as an eye-catching centerpiece. Various cake supports and cake stands have been devised to separate the layers of the cake into an imposing structure. These cake supports may be formed of metal or plastic and, in addition to adding structural rigidity to a multilayer cake, also increase the visual volume of the cake assembly without unduly adding to the number of servings. Modular cake stands provide for rapid assembly of the cake and convenient transportation from the bakery to the reception hall. Cake trays formed of molded transparent plastic to simulate the appearance of cut glass may have downwardly protruding legs which support the tray on the tabletop or on tubular plastic pillars.

The importance of the wedding cake calls for prominent lighting. However, the overhead lighting within a banquet hall cannot always be accurately controlled. Furthermore, because the cake is an edible product, usually iced with sugar-based frosting, it should be protected from elevated temperatures, such as might be generated by the long-term directing of a spotlight. Wax candles with their flickering flames have been a traditional way of calling attention to a cake. However, burning candles require supervision, and present a potential fire hazard in crowded locations. Moreover, wax from the candles may drip onto the cake surface or the surfaces of the serving plates causing an unsightly mess.

Thus, there exists a need for a display capable of elevating and illuminating a wedding cake (or other food items), securely supporting the cake layer, and displaying the cake in a manner that draws visual attention.

SUMMARY OF THE INVENTION

One aspect of the invention is an illuminated assembly for displaying a food item, such as a wedding cake, hors d'oeuvres, pie, other buffet items and the like. The assembly includes first and second plates, at least one hollow pillar, the first and second plates adapted to engage the at least one hollow pillar, a third plate adapted to engage the first plate defining a first enclosure, a first sheet including a plurality of fasteners, the first sheet adapted to reside within the first enclosure, a fourth plate adapted to engage the second plate defining a second enclosure, a second sheet adapted to reside within the second enclosure, and, a continuous string of a plurality of electric lights. A first portion of the lights is affixed to the second sheet, a second portion of the lights comprises one or more loops, each loop having respective proximal and distal portions. The proximal portion of each loop resides suspended within a corresponding hollow pillar. The distal portion of each loop of lights are removably fastened in the plurality of fasteners. The pillars can be fixedly engaged to the first and second plates by adhesive. The first portion of lights can be affixed to the second sheet by a hot melt adhesive. The hollow pillar(s) define a pathway for the continuous string of lights between first and second enclosures. The first sheet has at least one opening. The second sheet also has at least one opening. The first and second sheet openings are in registry with each corresponding hollow pillar and pathway for the continuous string of lights between the first and second enclosures. The illuminated displays of the present invention are very impressive to the observers such that many users prefer to leave the display illuminated even when the food items are removed.

In another aspect of the invention, the assembly includes at least 3 hollow pillars, wherein the second portion of lights includes at least 3 loops of lights, and wherein a proximal portion of each loop of lights resides suspended in a corresponding hollow pillar and the distal portion of each loop of lights are fastened to the plurality of fasteners. The plurality of fasteners may be a plurality of resilient clips affixed to the first sheet. The fasteners can be fixedly engaged to the first sheet by adhesive.

Another aspect of the invention relates to structures adapted to engage the third plate, first sheet and first plate. The third plate includes 3 or more tapered members, the first sheet includes 3 or more holes, and the first plate includes 3 or more receptacles. The tapered members are adapted to engage the holes and receptacles to secure the third plate, first sheet and first plate assembly.

Similarly, the invention includes structures adapted to engage the fourth plate, second sheet and second plate. The fourth plate includes 3 or more tapered members adapted to engage the second sheet and the second plate. The second sheet includes 3 or more holes, and the second plate includes 3 or more receptacles. The tapered members are adapted to engage the holes and receptacles to secure the fourth plate, second sheet and second plate assembly.

The first, second, third and fourth plates and pillars may be constructed from a polyacrylic. The first and second sheets and resilient clips may also be constructed from a polyacrylic.

Yet another aspect of the invention is a method of assembling the illuminated assembly. The method includes affixing the first and second plates to the at least one hollow pillar, and, threading each loop of lights through a corresponding pillar. Each loop comprises proximal and distal portions of lights, whereby the proximal portion resides within the hollow pillar and the distal portion resides in the upper enclosure. The method further includes fastening the distal portion of the lights to the first sheet, engaging the third plate, first sheet and first plate, and, engaging the fourth plate, second sheet and second plate.

Another aspect of the invention is assembling the illuminated assembly, wherein the assembly includes at least 3 pillars. After the first and second plates are affixed to the at least 3 hollow pillars, each loop of lights are threaded through a corresponding pillar, whereby each loop comprises proximal and distal portions. The distal portion of each loop is fastened to the first sheet. The proximal portion is suspended within the pillar. The third plate, first sheet and first plate are engaged, and the fourth plate, second sheet and second plate are engaged.

Another aspect of the invention is directed to a subassembly for use in a cake display assembly. The subassembly includes a first sheet, a second sheet, a plurality of fasteners affixed to the second sheet, and, a string of a plurality of lights. A first portion of the plurality of lights are affixed to the first sheet. A second portion of the plurality of lights includes one or more loops. The proximal portion of each loop is suspended between the first and second sheets within corresponding pillars. The distal portion of each loop is adapted to be fastened to the second sheet. The fasteners may be resilient clips. The first portion of the plurality of lights may be affixed to the first sheet by hot melt adhesive. The first and second sheets and resilient clips may also be constructed from a polyacrylic.

Still another aspect of the invention is a method of displaying a food item. The method includes providing one or more food items and providing one or more display assemblies, and contacting the one or more food items with one or more of the displays in a predetermined arrangement. The displays are illuminated by powering the string of lights. The string of lights can be powered by a wall outlet, a battery or another suitable power source. The food item may be wedding cake, hors d'oeuvres, pie or the like.

Still another aspect of the invention is a method of assembling the illuminated display assembly whereby first and second plates affixed to the at least one hollow pillar are provided. Another step includes threading each loop of the lights through a corresponding pillar. Each loop of lights comprises proximal and distal portions, which are threaded through corresponding pillars. Other steps include fastening the distal portion of the lights to the first sheet; engaging the third plate, first sheet and first plate; and, engaging the fourth plate, second sheet and second plate.

Further objects, features and advantages of the invention are apparent from the following detailed description taken in conjunction with the accompanying drawings.

BRIEF DESCRIPTION OF DRAWINGS OF PREFERRED EMBODIMENTS

The instant invention is not limited to the figures or drawings which are provided merely to illustrate some of the preferred embodiments of the invention.

DETAILED DESCRIPTION OF THE PREFERRED EMBODIMENTS

Figure 1:
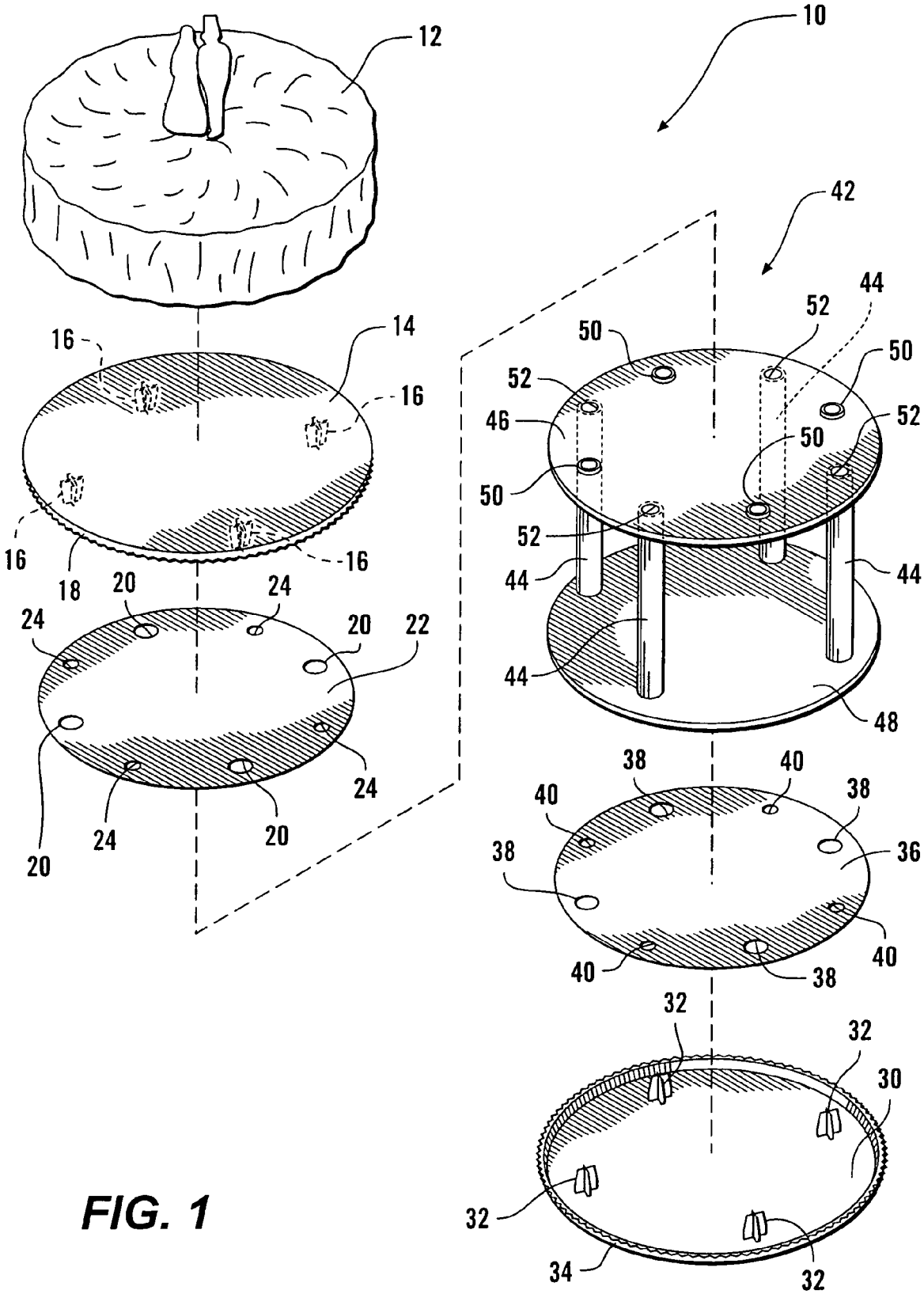
FIG. 1 shows a perspective view of one embodiment of the present invention being an unassembled display assembly having 4 hollow pillars for displaying a wedding cake.

As shown in FIG. 1, the display 10 for a wedding cake 12 includes several components. The display 10 can also be placed on top of another layer of cake 13 whereby a tiered wedding cake is displayed and illuminated by the present invention (see FIG. 4). All or most of the components in the display 10 may be constructed from a clear, transparent polyacrylic which provides a crystal-like appearance, particularly when illuminated. The components may also be made from other suitable plastic materials, such as polystyrene, polycarbonate or other suitable plastics. The plastic components may be made from the same material or different materials. The plastic material may be clear or tinted. The plastic material may also be transparent, translucent or partially transparent/translucent, which described materials are all referred to herein as "light transmitting.". The plastic components may be made by injection molding or other suitable processes.

As shown in FIG. 1, an upper cake plate 14 having four tapered legs 16 provides a surface to place the wedding cake 12. The upper cake plate 14 also includes a serrated and faceted rim edging 18 that provides a crystal-like appearance and accents to the illumination, such as sparkles and twinkles. The upper cake plate 14 engages an upper sheet 22 having hole openings 20, 24 therein. The tapered legs 16 engage holes 20 which are sized to engage the tapered portion of legs 16 (see also FIG. 4).

Similarly as shown in FIG. 1, the display 10 includes a lower cake plate 30 having four tapered legs 32 and a serrated and faceted rim edging 34 that also provides a crystal-like appearance and accents upon illumination. The lower cake plate 30 engages a lower sheet 36 having hole openings 38, 40 therein. The tapered legs 32 engage holes 38 which are sized to engage the tapered portion of legs 32 (see also FIG. 4). For a given display, the upper and lower cake plates 14, 30 may be identical and interchangeable; and, the upper and lower sheets 22, 36 may also be identical and interchangeable.

As shown in FIG. 1, the display 10 further includes a column assembly 42 to be situated between the upper and lower cake plates 14, 30 and sheets 22, 36. The column assembly 42 shown in FIG. 1 includes four pillars 44 affixed between an upper column plate 46 and a lower column plate 48. The pillars 44 can be affixed to the column plates 46, 48 at hollow openings 52 with an adhesive 47 (see FIG. 4). It can be envisioned that a single pillar could be used where the diameter of the pillar is sufficient for stability. It can further be envisioned that two pillars could be employed so long as they have sufficient diameter for stability. It can still further be envisioned that 3, 4, 5, etc. pillars could be employed in the column assembly 42 whereby stability is achieved without necessarily enlarged pillar diameter. The upper column plate includes four boss 50 receptacle structures affixed thereto and aligned with the holes 20 and tapered legs 16 for engagement (see FIG. 4). The lower column plate 48 also includes four boss 49 receptacle structures (shown in FIG. 2) affixed thereto and similarly situated so as to engage holes 38 and tapered legs 32 (see FIG. 4).

Similarly, hollow openings 52 in the upper and lower (shown in FIG. 1) column plates are aligned with pillars 44 and provide a means for threading a loop 80 (see FIG. 5) in the string of lights 60 through the column assembly 42. To that end, holes 24,40 in the upper and lower sheets 22, 36 are also aligned with the hollow openings 52 to permit threading of the loop 80 in a string of lights 60 (see FIGS. 4 and 5).

Preferably, the column assembly 42 is symmetrical such that it can be inverted (as shown) and still engage the upper and lower cake plates 14, 30 and sheets 22, 36. The display 10 provides a stable support for the wedding cake 12 due, in part, to engagement between the cake plates 14, 30 and the column assembly 42 which prevents slipping and sliding. At least three tapered legs 16, 32 are needed to prevent tipping. The volume between the upper cake plate 14 and the upper column plate 46 defines an upper enclosure 100 of limited height (see FIG. 4). Similarly, the volume between the lower cake plate 30 and the lower column plate 48 defines a lower enclosure 102 of limited height (see FIG. 4). As further shown in FIG. 4, the plastic sheets 22 and 36 are of limited thickness sufficient to secure the affixed fasteners and lights on the sheets in pre-selected positions when the sheets are respectively positioned within the upper and lower enclosures 100 and 102, without such thickness occupying a significant portion of the height of the enclosures 100, 102, and do not significantly reduce the volume of the enclosures 100 and 102.

Figure 2:
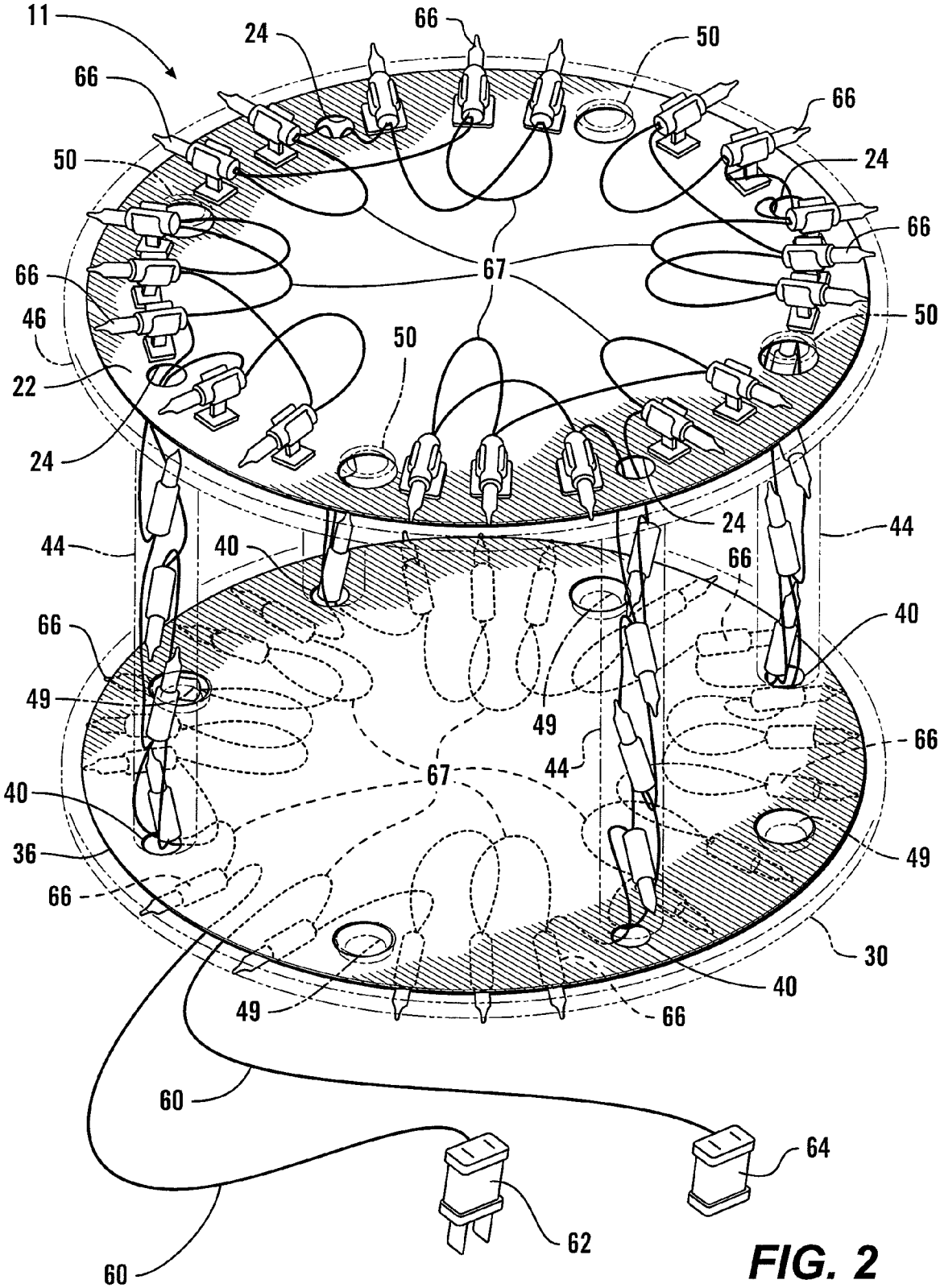
FIG. 2 shows a perspective view of the display shown in FIG. 1 assembled and including a string of lights incorporated within the display to illuminate the display assembly.

Shown in FIG. 2 is an assembled display 11 having a string of lights 60 fastened and threaded throughout the display 10 to provide illumination. The string 60 includes male 62 and female 64 electrical connectors for connection into a conventional wall socket (at, e.g., 110 volts), extension cord or the like, and a plurality of lights 66. Electrical power to the string of lights 60 may also be provided by one or more batteries or other suitable electrical power sources and associated electrical connectors. The wires 67 along the string of lights 66 is shown as a single wire for visual ease, however, most commercial string lighting is double-wired. Most commercial string lighting is also equally-spaced between the individual lights 66. FIGS. 2-5 show the individual lights 66 as being approximately equally-spaced.

Figure 3:
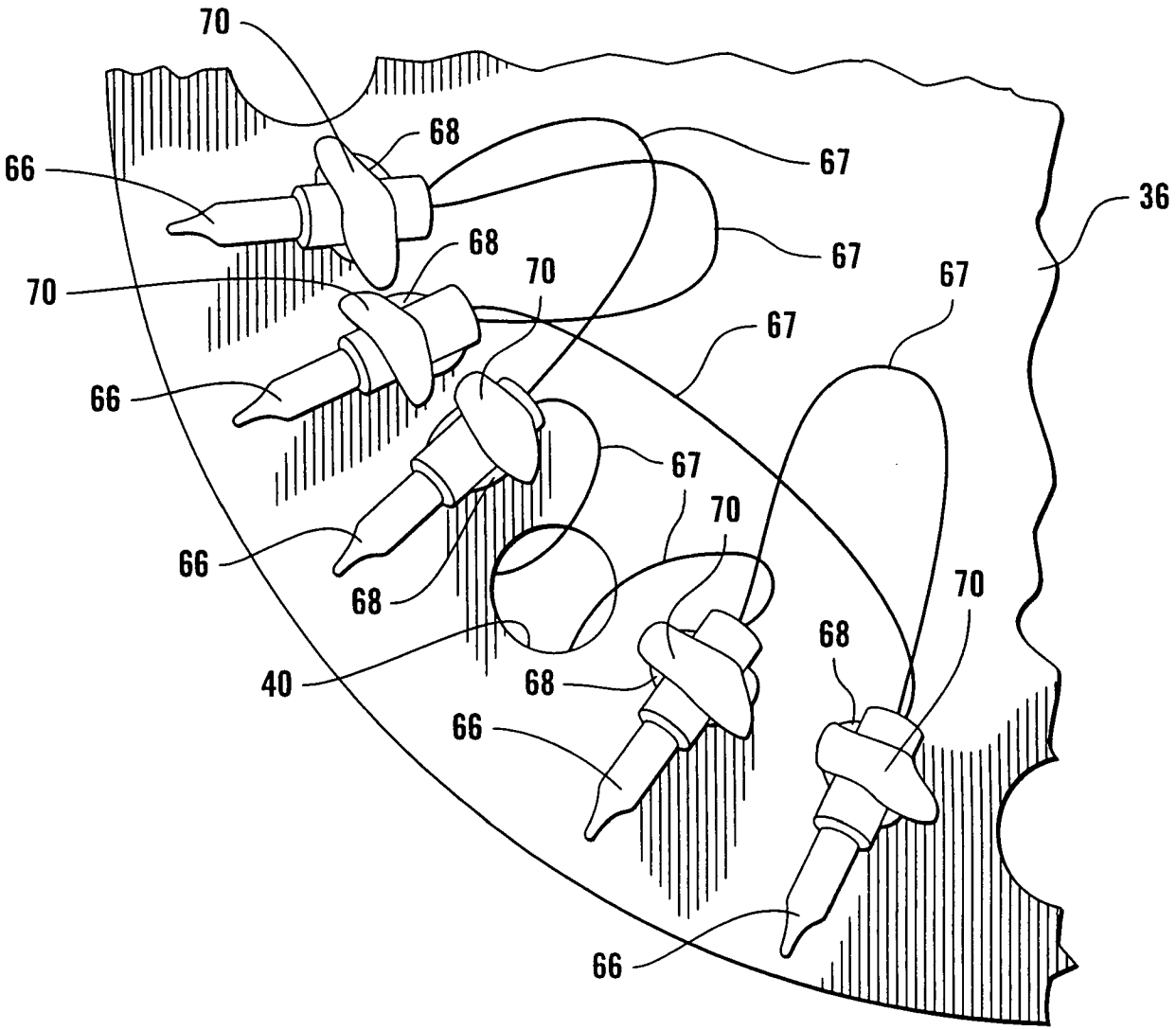
FIG. 3 shows a partial perspective view of one embodiment of the present invention whereby lights are affixed to one of the sheets with hot melt adhesive.
Figure 4:
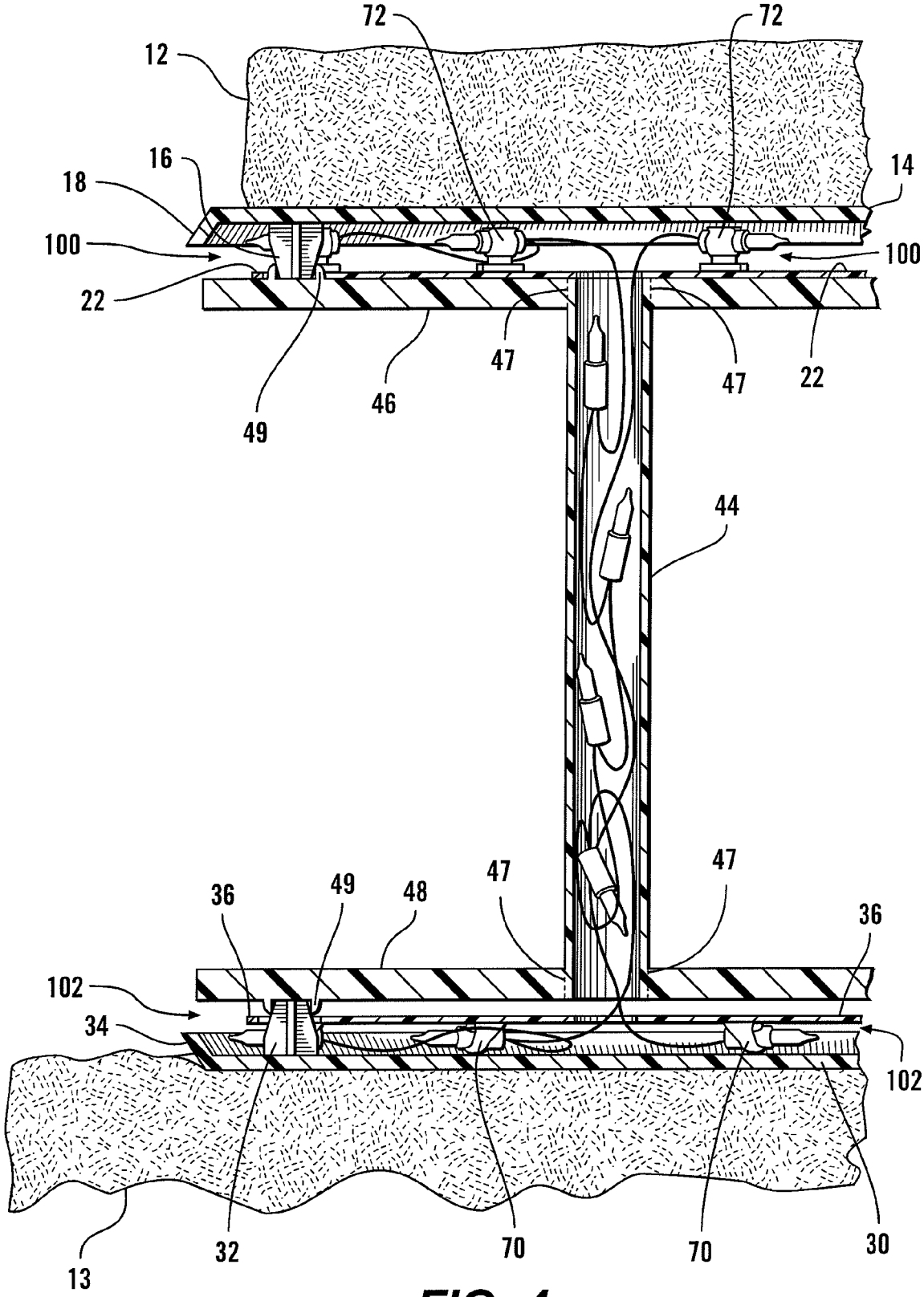
FIG. 4 shows a partial sectional side view of one embodiment of an assembled display assembly of the present invention.
Figure 5:
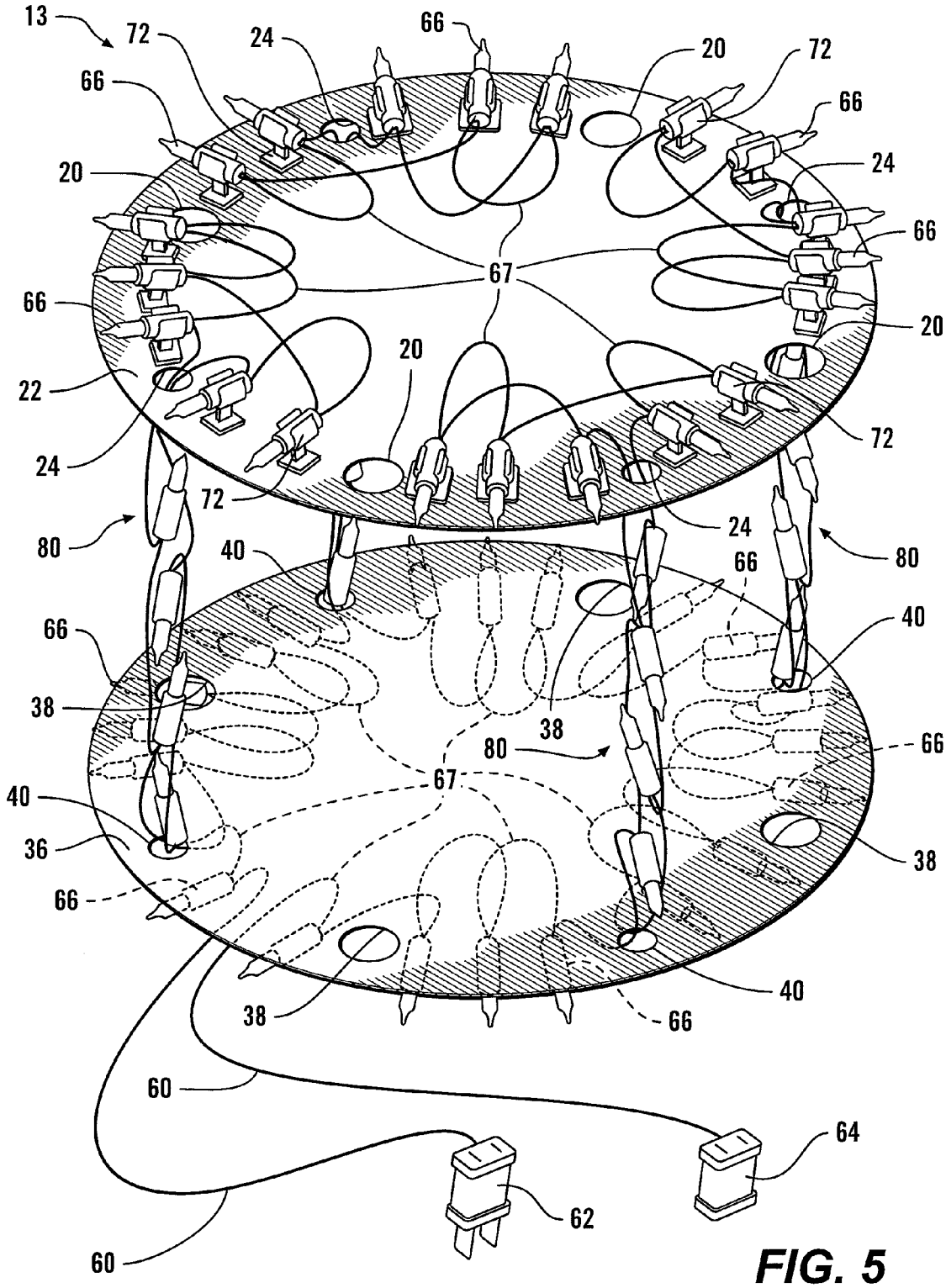
FIG. 5 shows a perspective view of one embodiment of the present invention being a subassembly.
Figure 6:
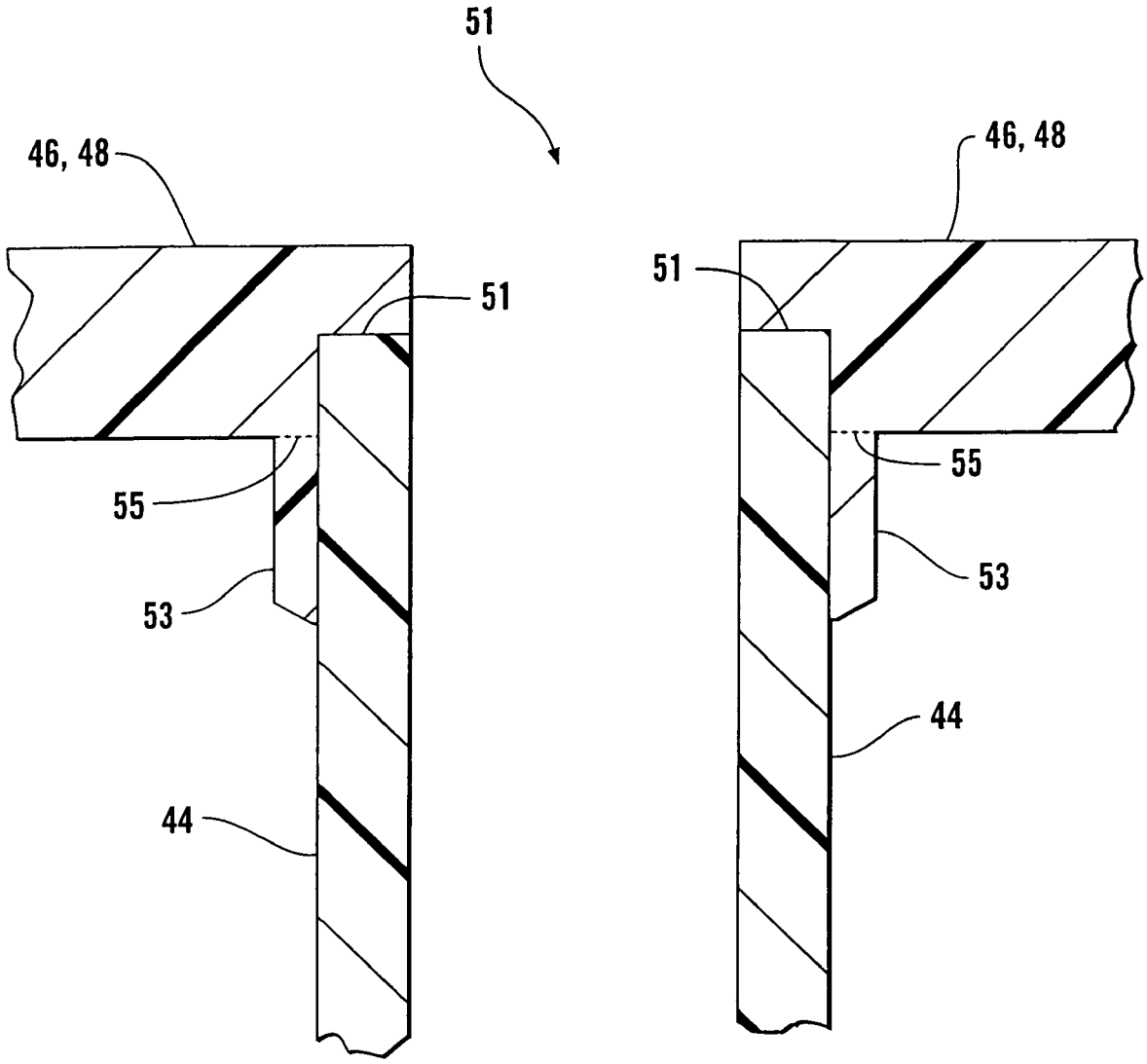
FIG. 6 shows a cross-sectional view of one embodiment of the present invention being a friction fit having an abutment between the pillar and the upper or lower plates.

The string of lights 60 is threaded through and fastened within the display 10. As shown in FIG. 3, the lights 66 are affixed to the lower sheet 36 by hot melt adhesive. Preferably, a dollop 68 of hot melt adhesive is located between the light 66 and the lower sheet 36, and a band 70 of hot melt adhesive lays over the light 66 and affixes to the lower sheet 36. As shown in FIGS. 4 and 5, each light 66 is removably fastened to the upper sheet 14 by a plastic resilient clip 72. The plastic clip 72 is affixed to the upper sheet 22 by an adhesive. It is also appreciated that because the assembled display 11 is symmetrical, the assembled display 11 can be inverted such that the sheet 36 having lights 66 affixed thereto by hot melt adhesive is situated above the sheet 22 having lights 66 removably fastened thereto. For ease of assembling and disassembling the string of lights 60 within the display 10, however, one of the sheets is adapted to fixedly attach the lights while the other sheet is adapted to removably attach the lights.

As shown in FIG. 5, another aspect of the invention is an assembled subassembly 13 comprising the two sheets 22, 36 having the string of lights 60 fixedly attached to sheet 36 and removably fastened to sheet 14. Preferably, the subassembly 13 is provided with the lights unfastened to sheet 14. Thus, the subassembly 13 could be provided separate from the column assembly 42 and cake plates 14, 30.

To assemble the display 11, the subassembly 13 is provided with the string of lights 60 unfastened from the top sheet 14. The lights 66 are affixed to the lower sheet 36 such that a loop 80 of lights 66 is provided for each pillar 44. The affixed lights 66 reside in the lower enclosure 102. In this embodiment, there are four loops 80 to be threaded through the four pillars 44. The loops 80 are threaded through the four pillars 44 whereby the proximal portion of each loop 80 resides within the pillar 44, and whereby the distal portion of each loop 80 resides in the upper enclosure 100. The individual lights 66 on the distal portion of each loop 80 are fastened within the nearby resilient clips 72 in an arrangement dictated by the lengths of the wire 67 between the lights 66. The length of the string of lights 60, the number of lights, and the spacing between lights is selected in accordance with the size of the display, the number of pillars and the desired degree of illumination as well as other suitable considerations.

While the displays 10, 11, 13 are shown to be circular in shape, it is appreciated that other embodiments of the invention include any other suitable shape, such as square, rectangular, oval, trapezoidal, triangular, etc. The sheets may be polyacrylic PETG discs having a thickness of 0.030 inch and obtainable from Laser Excel of Green Lake, Wis. The adhesive used to glue the pillars to the column plates; to glue the resilient clips to the upper sheet; and to glue the boss structures to the column plates may be a methyl methacrylic-based solvent cement such as Weld.On 3 obtainable from IPS Corporation of Gardena, Calif. The resilient clips may be polyacrylic clips obtainable from Emerald Innovations of Butler, Pa. The string of lights may be 110 volt end to end 50 white lights on a 20 ft white double-stranded white wire obtainable from Flora-Lite Company of Clearwater, Fla. The hot melt adhesive is obtainable from McMaster Carr of Chicago, Ill. under the product name Surebonder™.

As shown in FIG. 5, the pillar 44 (which defines the hollow opening 52, may also be fitted in frictional and mechanical engagement with the upper and/or lower plates 46,48. An abutment surface 51 further mechanically secures the pillar 44 preventing it from sliding through the upper and/or lower plates 46,48. A receptacle collar 53 may also be affixed 55 (e.g., by acrylic glue) to the upper and/or lower plates 46,48 to further secure the pillar 44 by frictional and/or mechanical engagement. It is understood that the receptacle collar 53 and other like/suitable components included herein may be integrally molded with an adjoining component or molded separately and affixed with, for example, glue or the like. This friction fitted embodiment may be preferred where disassembly of the column assembly 42 is desirable. This friction fitted embodiment is particularly preferred where a single pillar 44 is employed.

The invention has been described in conjunction with the exemplary embodiments outlined above. However, various alternatives, modifications, variations, substitutions and/or equivalents (whether known, foreseeable or unforeseeable) apparent to those having ordinary skill in the art are within the scope of the claimed invention so long as such does not depart from the spirit of the invention. Accordingly, the exemplary embodiments of the invention, as set forth above, are intended to be illustrative not limiting. Various changes may be made without departing from the spirit or scope of the invention.

I claim:

1. An illuminated cake display apparatus comprising:

first and second rigid plates, at least one hollow pillar, the first and second plates being adapted to engage the at least one hollow pillar with openings in the plates in communication with the interior of said at least one hollow pillar, a third plate adapted to engage the first plate to define a first enclosure of limited height, a fourth plate adapted to engage the second plate to define a second enclosure of limited height, the plates and the at least one hollow pillar being formed of light transmitting plastic material, a first light transmitting plastic sheet including a plurality of fasteners, the first sheet adapted to reside within the first enclosure, a second light transmitting plastic sheet adapted to reside within the second enclosure, the first and second sheets having openings in communication with the at least one hollow pillar and the communicating plate openings, and a continuous string of a plurality of electric lights, a first portion of the lights affixed to the second sheet, and, a second portion of lights comprising one or more loops, each loop comprising a proximal portion suspended in the hollow pillar and a distal portion of lights adapted to be fastened in the plurality of fasteners of the first sheet, wherein each hollow pillar and the communicating plate and sheet openings define a pathway for the continuous string of lights between the first and second enclosures, and the first and second sheets being of limited thickness sufficient to secure the affixed fasteners and lights on the sheets in pre-selected positions when the sheets are respectively positioned within the first and second enclosures of the cake display assembly without said thickness occupying a significant portion of the height of the enclosures.

2. The apparatus of claim 1, comprising at least 3 hollow pillars, wherein the second portion of lights includes at least 3 loops of lights.

3. The apparatus of claim 1, wherein the plurality of fasteners comprise a plurality of resilient clips, the clips affixed to the first sheet.

4. The apparatus of claim 1, wherein the third plate includes 3 or more first tapered members, wherein the first sheet defines 3 or more first holes, wherein the first plate includes 3 or more first receptacles, and wherein the first tapered members are adapted to engage the first holes and first receptacles.

5. The apparatus of claim 1, wherein the fourth plate includes 3 or more second tapered members, wherein the second sheet defines 3 or more second holes, wherein the second plate includes 3 or more second receptacles, and wherein the second tapered members are adapted to engage the second holes and second receptacles.

6. The apparatus of claim 1, wherein the pillars are fixedly engaged to the first and second plates by adhesive.

7. The apparatus of claim 1, wherein the fasteners are fixedly engaged to the first sheet by adhesive.

8. The apparatus of claim 1, wherein the first portion of lights are affixed to the second sheet by a hot melt adhesive.

9. The apparatus of claim 6, wherein any one of or any combination of the first, second, third and fourth plates; the first and second sheets; the pillars; and the resilient clips are constructed from a member selected from the group consisting of polyacrylic, polystyrene and polycarbonate.

10. An apparatus for illuminating a cake display assembly having a plurality of cake supporting light-transmitting rigid plastic plates which define spaced first and second enclosures of limited height between adjacent parallel plates, the apparatus comprising:

a first light-transmitting plastic sheet adapted to be positioned in the first enclosure, a second light-transmitting plastic sheet adapted to be positioned in the second enclosure, a plurality of fasteners affixed to the second sheet, and, a string of a plurality of lights, wherein a first portion of the plurality of lights are affixed to the first sheet, wherein a second portion of the plurality of lights comprises one or more loops each having a proximal portion adapted to be suspended between the first and second sheets and a distal portion adapted to be engaged in the fasteners affixed to the second sheet to thereby illuminate the first and second enclosures, and the first and second sheets being of limited thickness sufficient to secure the affixed fasteners and lights on the sheets in pre-selected positions when the sheets are respectively positioned within the first and second enclosures of the cake display assembly without said thickness occupying a significant portion of the height of the enclosures.

11. The apparatus of claim 10, wherein the fasteners are resilient clips.

12. The apparatus of claim 10, wherein the first portion of the plurality of lights are affixed to the first sheet by hot melt adhesive.

13. The apparatus of claim 11, wherein the first and second sheets and resilient clips are constructed from a polyacrylic.

14. A method of assembling the apparatus of claim 1 to display a food item comprising the steps of:

providing the first and second plates affixed to at least one hollow pillar, threading each loop of lights through a corresponding pillar, fastening the distal portion of the lights to the first sheet, engaging the third plate, first sheet and first plate, and, engaging the fourth plate, second sheet and second plate.

15. The method of claim 14, further comprising the steps of:

contacting the food item with the first plate, and, illuminating the continuous string of a plurality of electric lights.

16. The method of claim 15, wherein the food item is a member selected from the group consisting of cake, hors d'oeuvres and pie.

17. The apparatus of claim 10, wherein a hot melt adhesive affixes the first portion of the plurality of lights the first sheet.

18. The apparatus of claim 10, wherein the plurality of fasteners are resilient clips constructed from a polyacrylic.

19. The apparatus of claim 1, wherein the pillars are frictionally and mechanically engaged with the first and second plates.

20. The apparatus of claim 1 wherein the first and second sheet each have a thickness of approximately 0.030 inch.

21. The apparatus of claim 10 wherein the first and second sheet each have a thickness of approximately 0.030 inch.

* * * * *